United States Patent [19]

Gillaspie et al.

[11] Patent Number: 5,074,286

[45] Date of Patent: Dec. 24, 1991

[54] SPINAL MASSAGE TABLE

[76] Inventors: Steve L. Gillaspie, 3908 Rahn Rd., Eagan, Minn. 55122; Sidney C. Palmer, 5650 W. 177th St. #117, Farmington, Minn. 55024

[21] Appl. No.: 568,593

[22] Filed: Aug. 16, 1990

[51] Int. Cl.[5] ..... A61H 9/00; A47C 27/08

[52] U.S. Cl. ..... 128/33; 128/38; 128/66; 5/451; 5/453

[58] Field of Search ..... 128/24.1, 33, 38–40, 128/65, 66; 5/451, 453, 455, 456

[56] References Cited

U.S. PATENT DOCUMENTS

| | | | |
|---|---|---|---|
| 3,085,568 | 4/1963 | Whitesell . | |
| 3,317,934 | 5/1967 | Hinrichs . | |
| 3,420,226 | 1/1969 | Berry, Sr. . | |
| 4,112,943 | 9/1978 | Adams . | |
| 4,120,062 | 10/1978 | Anderson . | |
| 4,258,706 | 3/1981 | Shank . | |
| 4,330,893 | 5/1982 | Matsui | 5/451 |
| 4,564,965 | 1/1986 | Goodwin | 5/453 |
| 4,607,405 | 8/1986 | Ellis et al. | 128/66 X |
| 4,635,620 | 1/1987 | Ricchio | 5/453 X |
| 4,684,486 | 8/1987 | Ricchio | 5/453 X |
| 4,713,853 | 12/1987 | Ricchio | 5/453 X |
| 4,757,562 | 7/1988 | Mützell | 128/66 X |
| 4,763,367 | 8/1988 | Henkin et al. | 128/66 X |
| 4,837,880 | 6/1989 | Coffman | 5/453 X |

FOREIGN PATENT DOCUMENTS 2115190 10/1972 Fed. Rep. of Germany .

*Primary Examiner*—Robert A. Hafer
*Assistant Examiner*—Brian E. Hanlon
*Attorney, Agent, or Firm*—Vidas & Arrett

[57] ABSTRACT

A massage table which utilizes at least one rotating jet of water to create a rotating pressure ridge of water on the surface of a bladder, thereby creating muscular traction in the body of the user. By using several rotating jets of water a massage not unlike a natural hand massage is given due to the changing muscular traction caused by the interaction of the rotating jets of water.

19 Claims, 5 Drawing Sheets

SPINAL MASSAGE TABLE

BACKGROUND OF THE INVENTION

1. Field of the Invention

Spinal massage tables have been designed to give the user different kinds of sensations. These sensations may be pulses, vibrations, heat or massage-like actions with moving rollers, but not a truly continuous massaging effect on the spinal area which includes the muscular skeletal. The invention here however, does provide the user with a continuous massaging effect that also creates a mild form of muscular traction. A common type of fluid filled mattress is used. Generally, the fluid used is water. A configuration of a pump, manifold and special jets attached to the mattress are used to create the massaging effect.

2. Description of the Related Art

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56(a) exists.

In general, the prior practice in this area was to design a form of fluid filled bladder or bladders through which either fluid or air or both are moved by numerous means to create some type of rhythmic or repeating sensation to the user. The means of creating these movements could take the form of pulsation, vibration or pressure created by a pump.

The invention of Whitesell, U.S. Pat. No. 3,085,568 disclosed a fluid filled bladder through which fluid is moved by some type of mechanical or electrical piston containing device as to create a pulsating movement within the bladder. This sensation was then transferred onto the surface thereby effecting the user. This system also describes the use of sonic or uniform frequency to create a vibration effect on the fluid with the bladder thereby transmitting it to the user on the surface.

The invention of Hinrichs, U.S. Pat. No. 3,317,934 made use of multiple hollow chambers. The chambers could be made to alternatively expand and collapse by mens of reversible pumps that were connected by individual plumbing to the individual chambers. Through this means, the user could selectively change the pressure in any given one of the chambers. Changing pressure in the chambers could give a very crude type of massaging effect but was really more useful for simply shifting the pressure points at which the user's body came into contact with the mattress.

The invention of L. E. Berry Sr. U.S. Pat. No. 3,420,226 made use of an open top container such as a bath tub. Water is drawn from the container and pressurized by means of a pump and then injected back into the container by means of a series of inlets that create a turbulence within the container. The user is positioned within the container thereby receiving the benefit of a turbulent massage. This concept is better known as a hydrotherapy bath.

The invention of Cummins U.S. Pat. No. 4,066,072 made use of a fluid filled mattress to create a device with a series of sensors to monitor the continuous breathing and or heartbeat of an infant. While there is a means of circulating the fluid within the mattress, there is no claim of therapeutic value therein.

The invention of Fogel U.S. Pat. No. 4,077,074 is a means of supporting and containing a water filled mattress. Other than a structural device there appears to be no other therapeutic benefits other than what the user would receive by lying on the container mattress.

The invention of Adams, U.S. Pat. No. 4,112,943 details the act of drawing a heated liquid, such as water from a portable supply tank by using a form of circulating pump, which then pressurizes the liquid and forces it through a flexible hose into a flexible bag member. This bag member is supported by a movable adjustable arm. The bag member is supposedly placed on the portion of the body that is to receive treatment, as the liquid enters the bag, momentum is to be such that it will create a pressure on the opposing side of the bag thereby creating a therapeutic effect. As the liquid force disintegrates, the liquid is returned to the supply tank by another hose connected to the bag member completing the closed circulating process as described. While the therapeutic benefits may be questionable, it is portable as claimed which limits its use to a very small portion of the body at any given time.

The invention of Anderson U.S. Pat. No. 4,120,062 made use of a fluid filled bladder placed into a container designed to displace and disperse the fluid in case of leakage. Also, disclosed in the invention was a means by use of some type of mechanical or electrical piston containing device which would reciprocate at some rate of predetermined frequency. As the piston pushed outward, it would force a pulse of water through fluid bladder. This pulse would then be felt on the surface of the bladder in a rhythm similar to normal breathing.

The invention of Shank U.S. Pat. No. 4,258,706 uses a series of fluid filled bladders placed in a similar contour as a recliner chair, that may be inflated or deflated by use of a form of fluid pump and control valves on each inlet and outlet on each bladder. Each bladder also has a means of temperature control plus a means of invoking a vibration effect. The invention of Ellis et al U.S. Pat. No. 4,607,405 used a two chamber type of bladder supported by a container in such a manner to hold the bladder of sufficient height to create a cavity thereunder. The upper bladder chamber is filled with air while the lower chamber is filled with a fluid. Within the lower chamber is constructed three separate, while alike, devices that consist of a series of vertical tubes which are set in a circular manner. The top most part of these tubes are attached and protrude through and into the upper chamber. The lower part of these tubes are attached to a secondary circular chamber which is attached to the bottom of the lower chamber. Within the cavity under the chambers are located three forms of circulating pumps. Each pump has an inlet directly attached by means of a tube, to the lower chamber from which fluid is drawn, compressed by the pump and then injected by the means of a tube into the secondary chamber. Once the fluid is in the secondary chamber, it is dispersed to the vertical tubes through which the fluid is forced upward and into the upper chamber. The momentum of the fluid is supposedly such that it will continue upward until it hits the upper most part of the upper chamber creating a form of therapy on the surface thereof. As the force of the fluid is disintegrated, it will fall to the bottom of the upper chamber and by means of a one way valve return to the lower chamber for recirculation. There are a number of controls etc.

mentioned within the patent that have no bearing on the mechanics of the invention. In reviewing the components and design portrayed within this patent, a large number of dramatic changes would be required to make this system operate, let alone create any beneficial therapy value.

The invention to Riccho U.S. Pat. No. 4,713,853 uses a fluid filled bladder supported by a container designed in such a manner as to hold the bladder to a sufficient height to create a cavity thereunder. On the bottom most side of the bladder is an array of outlets and inlets attached thereto in specified locations. Fluid is drawn from the outlets by means of an arrangement of tubing to a fluid circulating pump. Within this tubing is an adaptor whereby air is injected by means of an air compressor pump. The fluid circulation pump compresses the air fluid mixture and forces it through an array of tubings which are attached to the series of inlets on the bottom most side of the bladder. The momentum of this mixture as it exists the inlet is supposedly such that it will travel vertically through the fluid until it reaches the top most side of the bladder. This is supposed to create a rippling effect on the surface thereof. At this time the air is supposedly separated from the water and escapes to either end of the bladder where there is a cavity to capture the air so that it may redrawn into the air compressor by a means of tubing or vented out by the means of a vent valve.

With references to Offenlegungsschrift: The invention of Offenlegungsschrift, West German Pat. No. 2,601,506 discloses a means of using a heated fluid or gas matter of which is circulated under the pressure by a form of a pump into a small flexible bladder. This bladder is placed on the area of the body which is to be treated.

The invention of Offenlegungsschrift, West German Pat. No. 2,115,190 uses a form of a chamber with a flexible type cover which is sealed around the top most edge of the container to hold a fluid filler. A means of circulating the fluid is disclosed whether by vibrations made by mechanical means or sound or by a circulating pump that will create an effect on the top most surface of the chamber.

Each of the aforementioned inventions use some form of bladder to hold a fluid matter. Each has a mean of creating some form of effect on the top most surface to said bladder. However, prior inventions inability to provide the user with a true therapeutic spinal massage, which includes the muscular skeletal related thereto, has given rise to find a means to provide this form of therapy. This invention fits the need.

SUMMARY OF THE INVENTION

The invention uses a fluid filled bladder, a means to support the bladder, fluid conduits arranged in such a manner as to allow the fluid to be drawn from the bladder into a circulating pump from which pressure is created and returned to and expelled into the bladder through one or more oscillating jets, in a continuous cycle. If one oscillating jet is used, it can create muscular traction by pushing against the weight of the body. If two oscillating jets are used they will create traction by their opposing forces. The addition of more jets simply adds to the surface area covered.

The oscillating jets are placed in such a manner within the bladder as to expel the stream of fluid at an angle toward the upper most surface of the bladder. The angle and depth of the jets are so that every rotation of each jet effects approximately a twelve inch diameter area on the surface of the bladder. The placement of jets are such that each jet overlaps a portion of the surface area covered by the other. And being that each jet oscillates at a different speed than the others, therefore, while one jet may be creating an outward push, another may be pushing inward and other pushing upward. This invention not only creates a massage not unlike a natural hand massage, but also creates a form of changing muscular traction not attainable by any other known means.

The method of drawing the fluid from and returning it into the bladder are also an improvement over means as taught by the aforementioned patents. The outlets and inlets into the bladder are placed in such a manner that if there was any leakage the safety liner would catch and contain the fluid to prevent damage.

BRIEF DESCRIPTION OF THE DRAWINGS

A detailed description of the invention is hereafter described with specific reference being made to the drawings in which.

DESCRIPTION OF THE PREFERRED EMBODIMENTS

Figure 1:
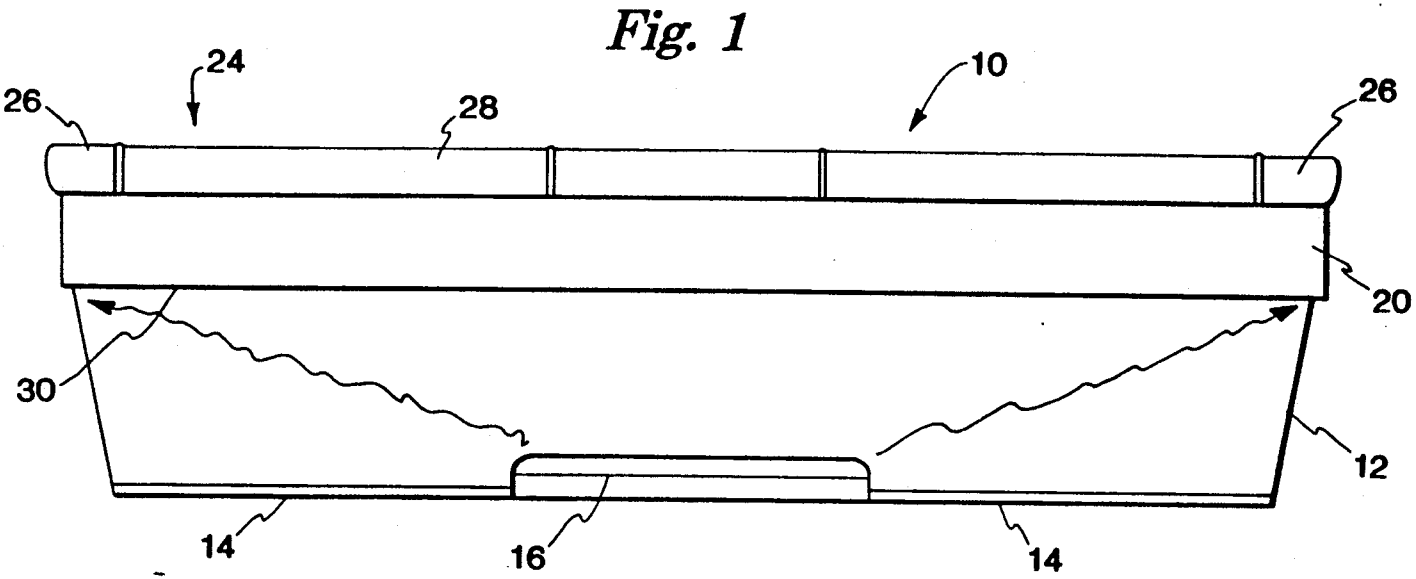
FIG. 1 is a side view of the inventive spinal massage table.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

Referring to FIG. 1, the inventive spinal massage table shown generally at 10 is supported by cabinet 12 which in turn is mounted on skids 14. The skids 14 enables spinal massage table 10 to be easily moved, although it should be understood that the units could also be mounted on casters or the like for total portability. Cabinet 12 has low air vents 16 positioned near the floor on either side of the cabinet and upper air vents 18 on either end of the cabinet (shown in FIGS. 2 and 3). Any number of air vents could be used and placed in any location, as desired. A natural flow of air is pulled in through the lower vents 16 and out through the upper vents 18 when the device is in operation to provide cooling for the apparatus mounted within the cabinet 12, which will be discussed further below.

Bladder retaining wall 20 is mounted onto cabinet 12 and provides a rigid support to contain the fluid filled bladder 22 (seen in FIGS. 3–8). A railing referred to generally as 24 is mounted on top of bladder retaining wall 20 to better enable a patient to get onto and off the spinal massage table 10. Rail 24 is made up of end sections 26 and side sections 28. The fluid filled bladder 22 is supported by the top of cabinet 12, shown at 30, with the sides of the bladder 22 supported by bladder retaining wall 20. Bladder 22 is sized so that when full with water or other fluid, its surface is slightly below the level of rail 24. The entire bladder 22 is covered with a fabric cover which is removable and stretchable and tucks around the bladder 22 in between bladder 22 and the bladder retainer wall 20. Bladder 22 is a regular waterbed type mattress in the preferred embodiment with a standard filler spout and sealer cap, which is sized to fit cabinet 12.

Figure 2:
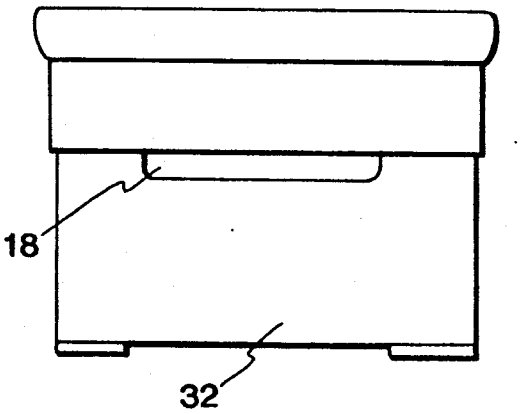
FIGS. 2 and 3 are end views of the table shown in FIG. 1.
Figure 3:
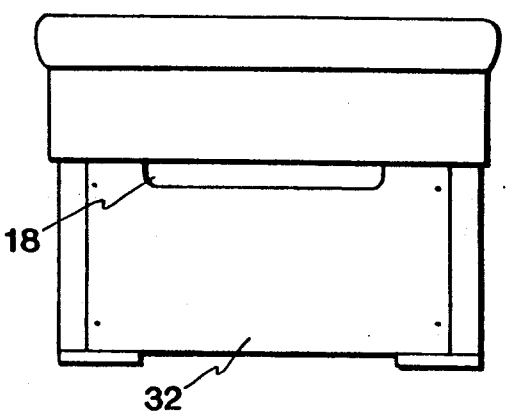

Referring now to FIGS. 2 and 3, end views of spinal massage table 10 are shown. End panels 32 are removable to allow access to the apparatus which will be discussed further below.

The cabinet may be made of any material such as wood, plastic, fiberglass or a combination of these items. All that is required for the cabinet 12 is that the top portion 30 of cabinet 12 be strong enough to support the fully filled bladder 22. The bladder retaining wall 20 must be strong enough to contain the fully filled bladder under the pressure exerted by a heavy person. Top portion 30 of the cabinet 12 is placed at a height above the ground sufficient to allow room for the apparatus to be stored inside the cabinet below the fluid filled bladder 22. In the preferred embodiment, its height is approximately 24 inches or higher, and of a length and width sufficient to accommodate a full grown person.

Figure 4:
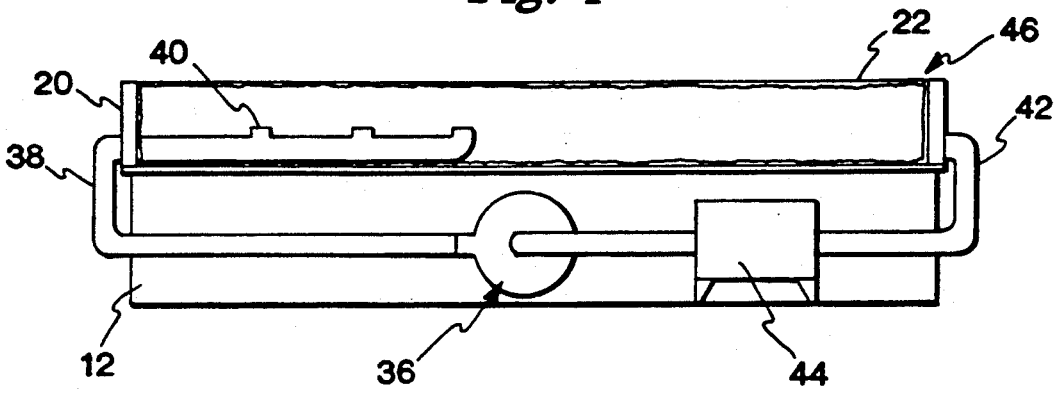
FIG. 4 is a schematic diagram of a first embodiment of the spinal massage table.

Referring now to FIG. 4, a first embodiment of the inventive spinal massage table 10 is shown schematically with bladder 22 supported by cabinet 12 and bladder retaining wall 28. The bladder 22 is filled with water in the preferred embodiment, although other fluids could be used. A centrifuge pump 36 forces water through inlet tube 38 and out through the three oscillating rotational jet assemblies, shown generally at 40, which extend upwardly from inlet tube 38. Fluid is removed through outlet 42 where it is run through fluid temperature maintainer 44 and back to centrifuge pump 36. When the device is on, fluid circulates continuously through the spinal massage table in a continuous cycle. The fluid temperature maintainer 44 simply maintains the temperature of the water at a predetermined temperature of 98° F., although the temperature could be anywhere within a ±6° F. range of 98° F. Below 92° F. the temperature will chill the body, and above 104° F. the temperature will become uncomfortable for many users. The temperature maintainer 44 can be any commercially available device. For low usage of the table it is anticipated that a simple fan working in conjunction with a heat transfer plate would maintain the temperature. For medium usage, more heat transfer plates could be added. For heavy usage a standard refrigeration unit could be used. In all arrangements a temperature sensor (not shown) could be utilized which would activate the temperature maintainer 44 if the temperature rises above a predetermined point. The excess heat is caused by the operation of the centrifuge pump and friction from the water being forced through the jets. The centrifuge pump is of the type used by spa and swimming pools manufactures. There are many different manufactures and models of these types of pumps and they are readily available. Rotational oscillating jet assemblies 40 expel the pressurized fluid in a flat fan pattern at an angle toward the upper most surface of the bladder 22. The jets are positioned at a distance of the surface of bladder 22, and the angle at which the jet of water is configured such that a complete rotation of the flat fan pattern of water effects approximately a 12" diameter area on the surface of the bladder. Of course, a greater or lesser surface area could be effected if desired simply by changing the angle or depth of the jet assemblies 40 from the surface of bladder 22. The flat fan pattern creates a ridge of water 12" across at the surface of bladder 22 in the preferred embodiment which rotates in a 360 degree circle. This ridge creates a force against the portion of the body pressing down on the bladder at that point. The three jet assemblies 40 each rotate at a different speed from the other. When the device is not in use, the surface of bladder 22 could be maintained at a comfortable temperature using a commercially available waterbed pad type heater.

Figure 9:
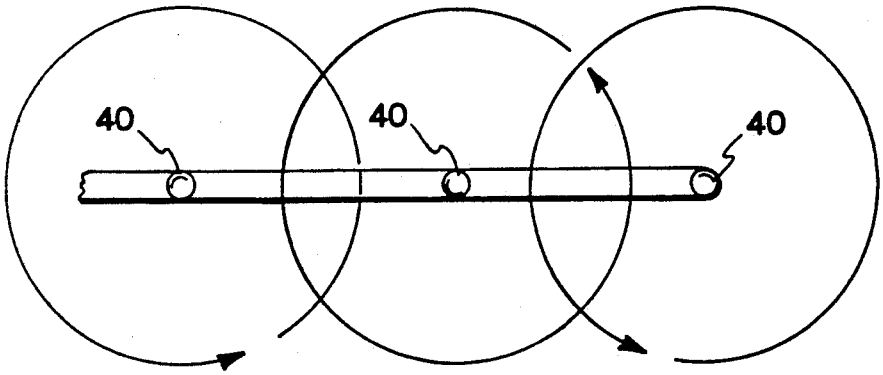
FIG. 9 is a top view of the pattern created by the rotational jets.
Figure 10:
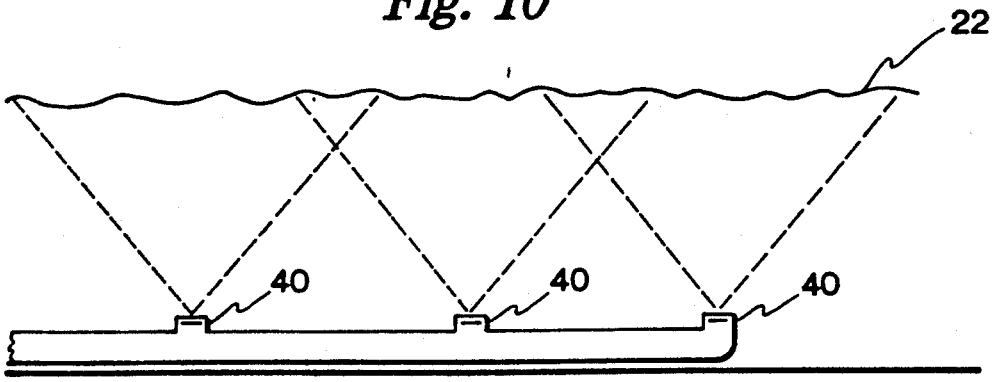
FIG. 10 is a side view of the pattern of FIG. 9.

The three jets are also placed so that each jet assembly 40 overlaps slightly with the portion of the surface area covered by the other (this is shown best with reference to FIGS. 9 and 10). By overlapping jet assemblies 40, and causing them to oscillate and rotate at a different speed, each from the other, a therapeutic massage is created which is not unlike a natural hand massage. This is caused by the fact that one jet may be creating an upward push, while another may be pushing inward and the third pushing upward. This tends to manipulate the muscles in different directions which creates a form of changing muscular traction which is unavailable by any prior art device.

Bladder 22 is contained in liner 46. Liner 46 is used to prevent damage in case of leaks from the inlet or outlet portion of the fluid movement system.

Figure 5:
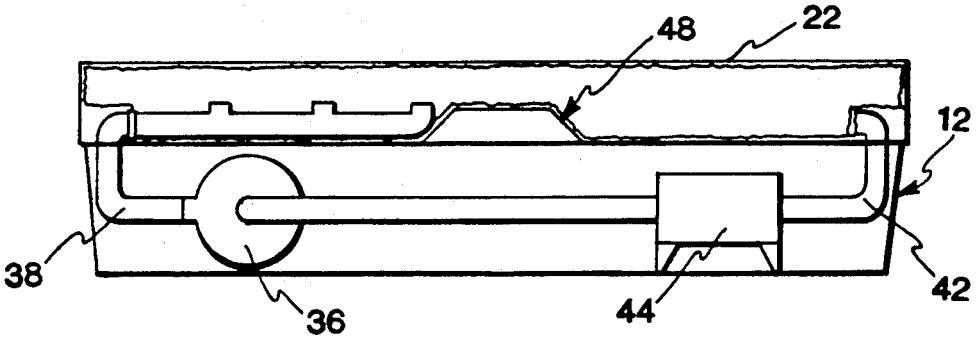
FIG. 5 is a schematic diagram of an alternate embodiment of the spinal massage table.

Referring now to FIG. 5, an alternative embodiment of FIG. 4 is shown which includes riser 48. Center riser 48 aids the user or patient when they are entering or exiting from the spinal massage unit and also acts to keep the patient at a level higher than the rotational jet assemblies 40. It can also be seen in FIG. 5 that the inlet pipe 38 and the outlet pipe 42 are contained in side cabinet 12 for a more pleasant appearance to the unit.

Figure 6:
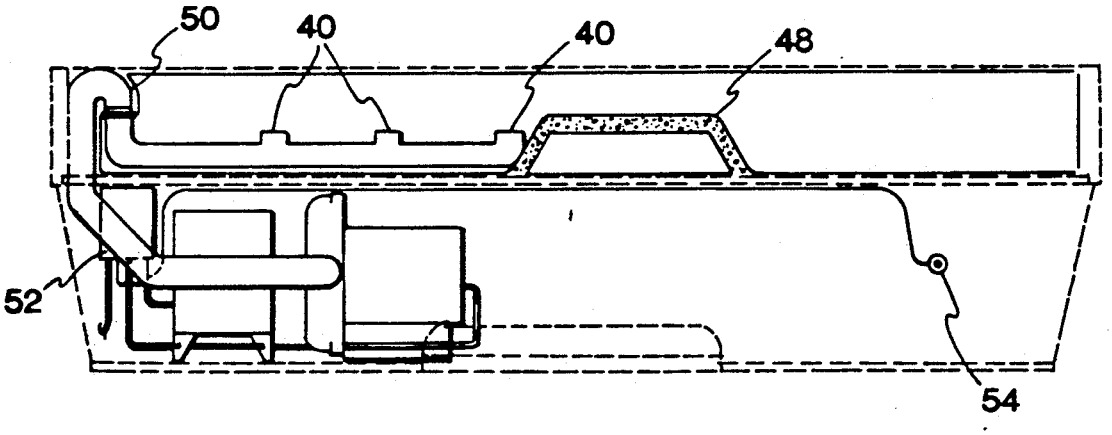
FIG. 6 is a schematic diagram of another alternate embodiment of the spinal massage table.
Figure 7:
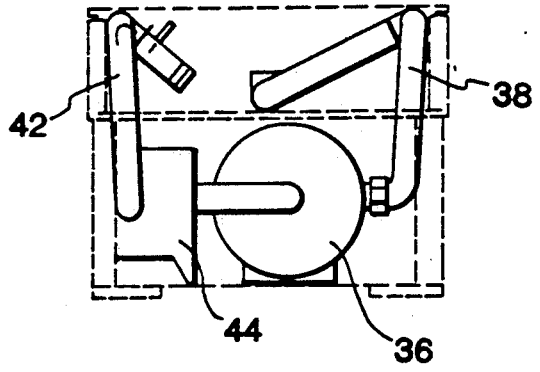
FIG. 7 is an end view of the table shown in FIG. 6.

Referring to FIGS. 6 and 7, an alternate embodiment is shown in which the inlet tube 38 and outlet tube 42 are both in the same end of the massage table 10. Additionally, the inlet and outlet tubes extend into the bladder 22 from the top portion of the bladder 22 shown at 50. Therefore, if any leaking was to take place at the point where the inlet and outlet tubes 38 and 42 enter the bladder 42, the liner 46 will more likely contain the leakage. Other arrangements of inlet and outlet tubes 38 and 42 are contemplated and are to be considered part of this invention. For example, it would be possible for inlet and outlet tubes 38 and 42 to share the same opening in bladder 22 to cut down on the danger of leaking. Electrical control box 52 controls the operation of the unit by controlling the centrifuge and the temperature fluid maintainer unit. The apparatus is powered by a power supply which is adapted for standard 110/220 electrical service. The timer or switch 54 can also be used to turn the device on, or turn it on for a pre-defined time period.

Figure 8:
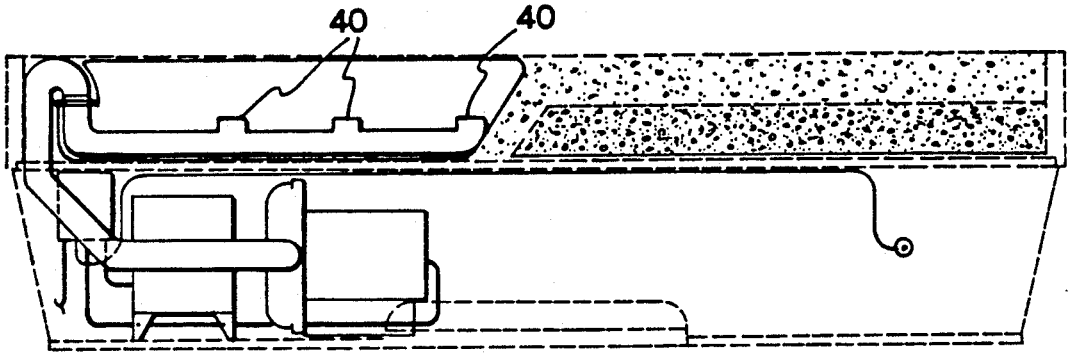
FIG. 8 is a schematic diagram of another alternate embodiment of the spinal massage table.

Referring now to FIG. 8, an alternate embodiment is shown in which bladder 22 is sized only large enough to contain rotational oscillating jet assemblies 40. The bulk of the bladder is made of a layer of high density foam covered with a second layer of low density foam which gives the user or patient the sensation of lying on a fluid filled bladder. The advantage of using a reduced size bladder 22 is that the entire unit is lighter and easier to move. In this embodiment, the user's body is also stabilized by the non-moveable foam, which adds in creating traction when one jet only is used.

Referring now to FIGS. 9 and 10, top and side views of the flat fan fluid produced by jet assemblies 40 is shown. It can be seen that there is a slight overlap of surface area effected by the ridge of water. It can also be seen that in this embodiment all three jets of water rotate counterclockwise. It should be understood that any number of jet assemblies 40 could be utilized with lesser and greater amounts of overlaps, if any, and the jets could rotate in the same direction or in opposite directions as may be desired. It could be seen in FIG. 10 that the angle at which the flat fan pattern ascends toward the surface of bladder 22 is 45 degrees in the preferred embodiment, although this could be altered depending upon the desired surface area to be effected by the ridge of pressurized water.

Figure 11:
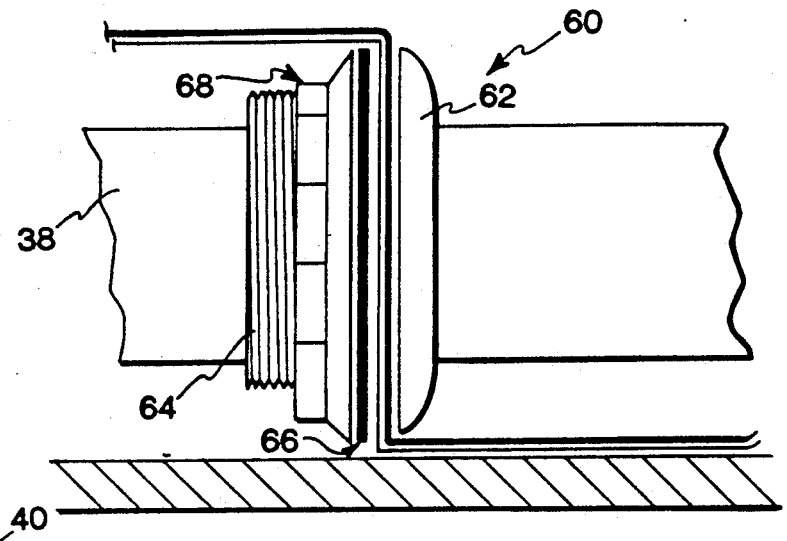
FIG. 11 is side view of the means of sealing the inlet and outlets into the bladder.

Referring now to FIG. 11, a sealing means shown generally at 60 is used in many different spa and swimming pool products and is readily available from several manufactures, and allows the inlet tube 38 or outlet tube 42 access to bladder 22 without causing leakage. Bladder 22 and liner 46 fit between the retainer and nipple 64. A sealing gasket 66 is inserted and the entire device is tightened using tension nut 68.

Figure 12:
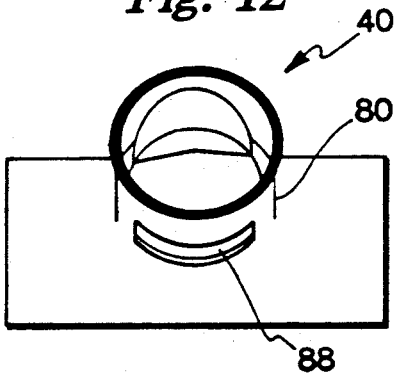
FIGS. 12 through 14 show an embodiment of the jet assembly.
Figure 13:
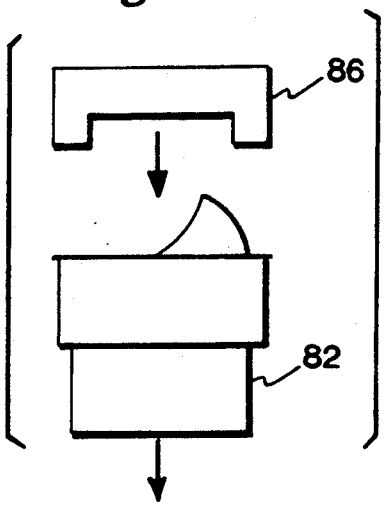
Figure 14:
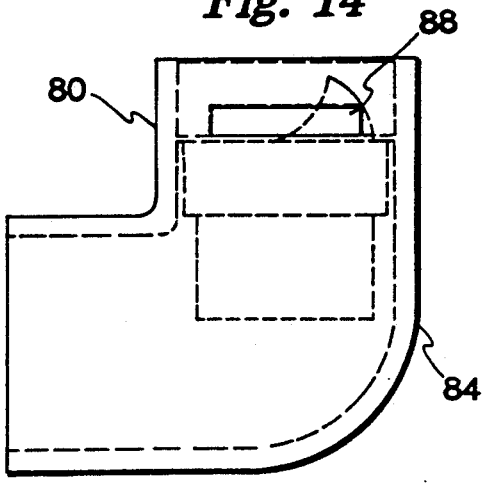

Referring now to FIGS. 12 through 14, a first embodiment of the jet assembly 40 is shown. Inlet tube 38 contains a short section of tubing 80 which extends upwardly from inlet tube 38. The rotational jet 82 is sized to fit inside tube elbow or T-section 84 which form tubing 80. The rotational jets used in the preferred embodiment are of the type disclosed in U.S. Pat. No. 4,559,653. Retainer piece 86 is used to secure the rotational jet 82 inside tubing 80. Retainer piece 86 also creates a guard which protects the jet from coming into contact from the user. Tube 80 contains a vacuum release opening 88 which allows fluid access to the rotational jet to counteract the vacuum formed by the upward force of fluid through the jet 82. This increases the upward force of the fluid expelled from rotational jet 82.

Figure 16:
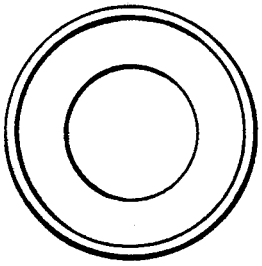
FIGS. 15 and 16 show an alternate embodiment of the jet assembly.
Figure 15:
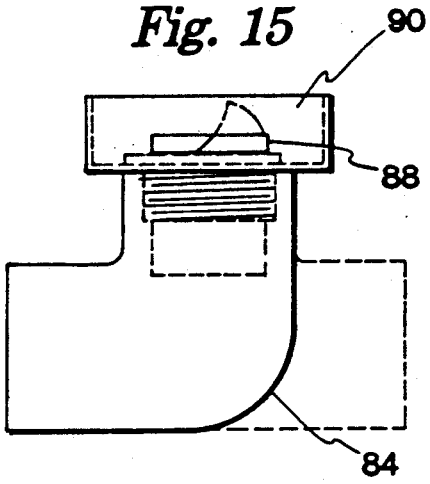

Referring now to FIGS. 15 and 16, an alternative embodiment of jet assembly 40 is shown. Rotational jet 82 is inserted or mounted inside elbow or T-section 84, but extends slightly from the tube section 80. A jet guard 90 (a top view of which is shown in FIG. 16) is used to prevent the user from contacting the jet 82.

Figure 17:
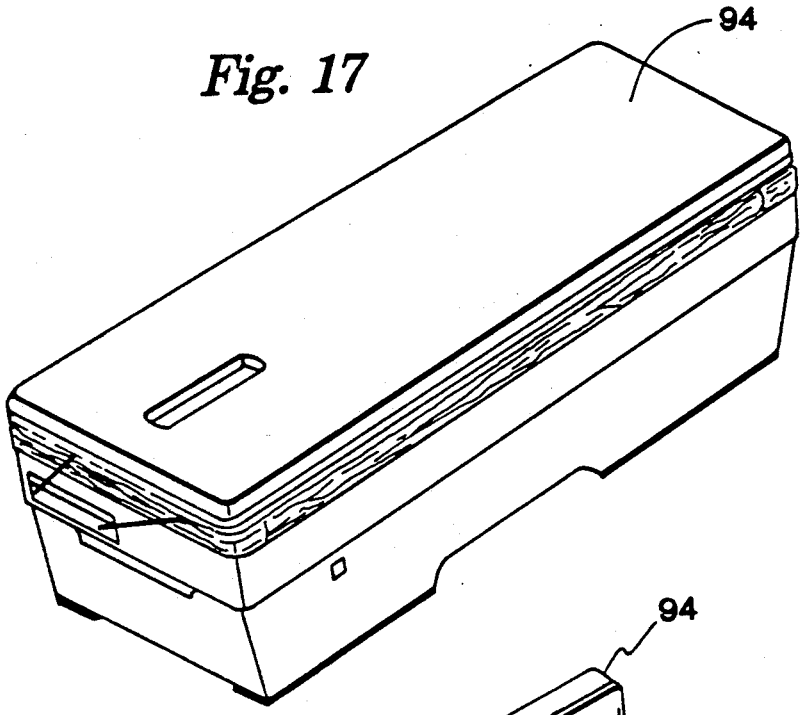
FIGS. 17 and 18 show an alternate embodiment of the inventive spinal massage table which includes a retractable cover.
Figure 18:
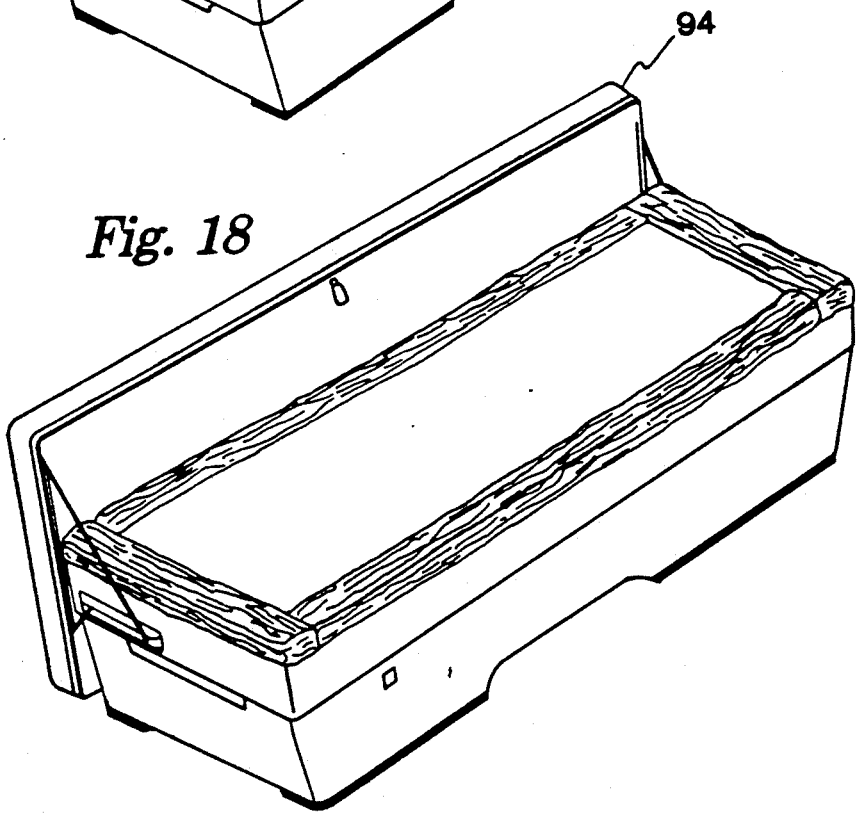

Referring now to FIGS. 17 and 18, an alternate embodiment of the spinal massage table 10 is shown which includes a retractable cover 94. Cover 94 is shown in the closed position in FIG. 17, which allows the massage table 10 to be used as an examination table, an adjustment table or a therapy table. When the cover 94 is retracted as shown in FIG. 18, the table may be used as a spinal massage table 10.

Another alternate embodiment of spinal massage table 10 is to simply place the bladder 22 on a regular bed frame (not shown). The apparatus stored beneath cabinet 12 would be configured as a portable unit which would be connected to the bladder 22 by means of flexible tubing. This would allow the unit to be easily transported and set up outside the office environment.

It is also contemplated that various strap or belt arrangements could be used to hold the user more securely in place. These straps could be buckle or Velcro TM straps, and could be slidably mounted to cabinet 12 for ease of positioning for individual users.

This completes the description of the preferred and alternate embodiments of the invention. Those skilled in the art may recognize other equivalents to the specific embodiment described herein which equivalents are intended to be encompassed by the claims attached hereto.

What is claimed is:

1. A massage table comprising:

a fluid filled bladder having a top and bottom surface and sides;

a bladder support means constructed and arranged to support the bottom and sides of the fluid filled bladder;

inlet tubing means extending into the bladder for carrying pressurized fluid;

outlet tubing means extending out of the bladder for removing water from the fluid filled bladder;

pump means connected to both the inlet and outlet tubing means for receiving fluid from the outlet tubing means and pumping it into the inlet tubing means under pressure;

at least one rotatable jet means connected to the inlet tubing means inside the fluid filled bladder for directing the pressurized water flow toward the top surface of the fluid filled bladder such that a predetermined portion of the surface area of the bladder is under pressure from the flow of fluid, the rotatable jet means defining an axis which is perpendicular to the plane defined by the bottom bladder support means, wherein the pressurized water flow rotates about said axis.

2. The massage table of claim 1 including a temperature maintenance means which maintains the temperature of the fluid circulating to within a ± six degree range of normal inner body temperature.

3. The massage table of claim 2 including a plurality of rotatable jet means connected to the inlet tubing means inside the fluid filled bladder for directing the pressurized water flow toward the top surface of the fluid filled bladder such that a predetermined portion of the surface area of the bladder is under pressure from the flow of fluid, the rotatable jets being positioned such that the surface area affected by each jet means overlaps with one or more of the other jet means.

4. The massage table of claim 3 wherein the rotatable jet means all rotate in the same direction, but each at slightly different speeds, thereby creating a form of traction on the muscular skeleton of the person lying on the bladder due to the pressure of the different jet means pushing and pulling the muscles of the person in different directions.

5. The massage table of claim 4 further including a riser means which supports the person getting onto or off of the massage table, such that the person will not come into contact with any of the jet means.

6. The massage table of claim 4 wherein the inlet and outlet tubing means are located at the same end of the massage table.

7. The massage table of claim 4 wherein the fluid filled bladder is sized to contain only the area necessary to contain the jet means, with the balance of the bladder being made of foam which approximates the feeling of lying on fluid.

8. The massage table of claim 4 wherein the jet means includes a flat fan nozzle to create a pressure ridge of water approximately 12 inches across at the surface of the bladder.

9. The massage table of claim 4 wherein the jet means includes a guard means which prevents the person from coming into contact with the jet means when getting onto or off of the massage table, or while lying on the massage table.

10. The massage table of claim 1 including a retractable cover means which may be closed to cover the surface of the bladder and provide a firm surface for use of the massage table as an examination, adjustment or therapy table.

11. A massage table which also functions as an examination, adjustment or therapy table, the massage table comprising:

a fluid filled bladder having a top and bottom surface and sides;

a bladder support means constructed and arranged to support the bottom and sides of the fluid filled bladder;

a retractable cover means attached to the bladder support means which may be closed to cover the surface of the bladder and provide a firm surface for use of the massage table as an examination, adjustment or therapy table;

inlet tubing means extending into the bladder for carrying pressurized fluid;

outlet tubing means extending out of the bladder for removing water from the fluid filled bladder;

pump means connected to both the inlet and outlet tubing means for receiving fluid from the outlet tubing means and pumping it into the inlet tubing means under pressure;

at least one rotatable jet means connected to the inlet tubing means inside the fluid filled bladder for directing the pressurized water flow toward the top surface of the fluid filled bladder such that a predetermined portion of the surface area of the bladder is under pressure from the flow of fluid, the rotatable jet means defining an axis which is perpendicular to the plane defined by the bottom bladder support means, wherein the pressurized water flow rotates about said axis, whereby the retractable cover can be closed for using the table as an examination, adjustment or therapy table or opened for use as a massage table.

12. The massage table of claim 11 including a temperature maintenance means which maintains the temperature of the fluid circulating to within a ± six degree range of normal inner body temperature.

13. The massage table of claim 12 including a plurality of rotatable jet means connected to the inlet tubing means inside the fluid filled bladder for directing the pressurized water flow toward the top surface of the fluid filled bladder such that a predetermined portion of the surface area of the bladder is under pressure from the flow of fluid, the rotatable jets being positioned such that the surface area affected by each jet means overlaps with one or more of the other jet means.

14. The massage table of claim 13 wherein the rotatable jet means all rotate in the same direction, but each at slightly different speeds, thereby creating a form of traction on the muscular skeleton of the person lying on the bladder due to the pressure of the different jet means pushing and pulling the muscles of the person in different directions.

15. The massage table of claim 14 further including a riser means which supports the person getting onto or off of the massage table, such that the person will not come into contact with any of the jet means.

16. The massage table of claim 14 wherein the inlet and outlet tubing means are located at the same end of the massage table.

17. The massage table of claim 14 wherein the fluid filled bladder is sized to contain only the area necessary to contain the jet means, with the balance of the bladder being made of foam which approximates the feeling of lying on fluid.

18. The massage table of claim 14 wherein the jet means includes a flat fan nozzle to create a pressure ridge of water approximately 12 inches across at the surface of the bladder.

19. The massage table of claim 14 wherein the jet means includes a guard means which prevents the person from coming into contact with the jet means when getting onto or off of the massage table, or while lying on the massage table.

* * * * *